US008667818B1

(12) United States Patent
Mchatet

(10) Patent No.: US 8,667,818 B1
(45) Date of Patent: Mar. 11, 2014

(54) PACKAGING LOCK ASSEMBLY

(71) Applicant: Hamid Mchatet, Miami, FL (US)

(72) Inventor: Hamid Mchatet, Miami, FL (US)

( * ) Notice: Subject to any disclaimer, the term of this patent is extended or adjusted under 35 U.S.C. 154(b) by 0 days.

(21) Appl. No.: 13/939,624

(22) Filed: Jul. 11, 2013

(51) Int. Cl.
*E05B 73/00* (2006.01)

(52) U.S. Cl.
USPC ..... 70/14; 70/57.1; 70/58; 211/4

(58) Field of Classification Search
USPC ..... 70/14, 57.1, 58, 169; 211/4
See application file for complete search history.

(56) References Cited

U.S. PATENT DOCUMENTS

| | | | | |
|---|---|---|---|---|
| 5,259,220 | A * | 11/1993 | Fredrickson | 70/14 |
| 5,275,027 | A | 1/1994 | Eklof et al. | |
| 5,390,515 | A * | 2/1995 | Essick | 70/63 |
| 5,485,929 | A * | 1/1996 | Danon | 211/57.1 |
| 5,509,528 | A * | 4/1996 | Weisburn | 206/45.24 |
| 5,624,040 | A | 4/1997 | Hono | |
| 5,711,432 | A | 1/1998 | Stein et al. | |
| 5,996,817 | A | 12/1999 | Kao | |
| 6,076,669 | A | 6/2000 | Ling | |
| 6,279,256 | B1 * | 8/2001 | Norolof et al. | 40/642.01 |
| 6,837,373 | B2 | 1/2005 | Huang | |
| 6,854,594 | B2 | 2/2005 | Vasudeva et al. | |
| 6,957,555 | B1 | 10/2005 | Nagel et al. | |
| 6,966,438 | B2 * | 11/2005 | Belden et al. | 206/308.1 |
| 7,137,513 | B2 | 11/2006 | Sedon et al. | |
| 7,269,983 | B1 | 9/2007 | Mchatet | |
| 7,350,645 | B1 * | 4/2008 | Sills | 206/461 |
| 7,624,871 | B2 | 12/2009 | Sills | |
| 2005/0230587 | A1 | 10/2005 | Yang | |

* cited by examiner

*Primary Examiner* — Suzanne Barrett
(74) *Attorney, Agent, or Firm* — Albert Bordas, P.A.

(57) ABSTRACT

A lock assembly for retail packaging, having a lock assembly, a key assembly, a hinge assembly, and packaging comprising at least one wall. The lock assembly mounts exteriorly onto the packaging. The packaging lock assembly may further have a rail assembly mounted onto a display rack. The rail assembly comprises rail members and a transversal member. The packaging lock assembly may further have a plate assembly positioned in between the lock assembly and the plate. The lock assembly suspended from the rail members is placed in a locked position, whereby a locking shaft assembly is blocked by the transversal member to prevent removal of the packaging from the rail assembly. The key assembly is presented into a latch assembly comprising a key hole to cause the locking shaft assembly to shift from the locked position, to an unlocked position.

13 Claims, 8 Drawing Sheets

PACKAGING LOCK ASSEMBLY

BACKGROUND OF THE INVENTION

1. Field of the Invention

The present invention relates to lock assemblies, and more particularly, to lock assemblies for retail packaging.

2. Description of the Related Art

Applicant believes that one of the closest references corresponds to Applicant's own U.S. Pat. No. 7,269,983 issued on Sep. 18, 2007 for a lock assembly. However, it differs from the present invention because Applicant then taught a lock assembly including a lock, a key and a rail assembly. The lock includes a lock housing and an actuating housing. The lock housing includes a rear notch, an internal notch that houses a spring and a locking tab, and an aperture that houses a second spring. A vertical track member is mounted to the rear notch and it has a vertical cutout. The actuating housing includes rear, lateral and top walls and a protrusion with a notch. The actuating housing is slidably mounted to the lock housing with a pin. The rail assembly is mounted to racks in stores wherein products for display are mounted thereto. The lock mounts onto the rail assembly by inserting the transversal member of the rail behind the protrusion and pressing the actuating housing against the lock housing until the locking tab engage into the notch.

Applicant believes that another reference corresponds to U.S. Patent Application Publication No. 20050230587 A1, published on Oct. 20, 2005 to Yang for a display device for article for sale. However, it differs from the present invention because Yang teaches a display device includes a plug device having a housing engageable into a hole of an article for sales, the housing includes a chamber and a spring blade having a projection to engage into a depression of the article, and for detachably attaching the housing to the article. A hanger device includes an actuator engageable into the chamber of the housing, to selectively engage with the spring blade of the housing, and to force and retain the projection of the spring blade within the depression of the article, and thus to detachably lock the housing to the article with the actuator of the hanger device. A locking device may be used to lock the actuator of the hanger device to the housing of the plug device.

Applicant believes that another reference corresponds to U.S. Pat. No. 7,624,871 B2 issued to Sills on Dec. 1, 2009 for a product security system for hanging merchandise. However, it differs from the present invention because Sills teaches a security system for preventing theft of hanging merchandise. The present invention includes a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,350,645 B1 issued to Sills on Apr. 1, 2008 for a product security system for hanging merchandise. However, it differs from the present invention because Sills teaches a security system for preventing theft of hanging merchandise. The present invention includes a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,137,513 B2, issued on Nov. 21, 2006 to Sedon, et al. for a merchandise display system. However, it differs from the present invention because Sedon, et al. teaches a merchandise display system includes a rod lockably connected to a peg board, a hanging member hanging from the rod and a swivel member rotatably connected to the hanging member about a first axis. The swivel member is connected to a lockable display case for carrying an item of merchandise and is rotatable about a second axis perpendicular to the first axis. Thus, the display case is rotatable about the first and second axes to facilitate viewing the merchandise from any angle while the case is lockably connected to the rod. The hanging and swivel members may be a ball and socket combination. Alternately, the swivel member may connect to the display case via a hinge pin about which portions of the case may rotate to open and close. Alternately, a lower member may extend from within the case through holes therein to rotatably connect to the swivel member about the second axis.

Applicant believes that another reference corresponds to U.S. Pat. No. 6,957,555 B1 issued to Nagel, et al. on Oct. 25, 2005 for a locking attachment for product display hooks. However, it differs from the present invention because Nagel, et al. teaches a merchandise locking device for retrofit attachment to a product display hook installed on a merchandise display panel. The locking device attaches without tools to the upper wire arm of the display hook for pivoting movement between "lock" and "open" positions. A laterally opening recess in the locking device receives the lower arm of the display hook and a locking arm, rotatably mounted in the body of the locking device by a rotor element, closes the recess to lock the device to the lower arm and prevent the removal of merchandise therefrom. A simple key carried by store personnel enables the rotor to be released to free the locking device from the lower arm and permit the removal of merchandise. The locking device consists of four elements, including the key, and can be manufactured at very low cost, suitable for mass merchandise applications. Simple changes in rotor components enable the locking device to be operated by different keys, which may be color coded with the locking devices or components thereof. A bracket is also provided for retrofit attachment to the display hook, to prevent bodily removal of the hook and its contents from the display panel. Applicant believes that another reference corresponds to U.S. Pat. No. 6,854,594 B2 issued to Vasudeva, et al. on Feb. 15, 2005 for a product holder with point-of-sale security. However, it differs from the present invention because Vasudeva, et al. teaches a point-of-sale security system is provided herein. The security system includes a container for containing the product and a holder assembly, the holder assembly including a closure device for closing the container. The holder assembly and the container are operatively coupled together by means of cooperative members. The cooperative members being configured in a special way, i.e., when an associated stop member is enabled, the cooperative members prevent decoupling of the holder assembly from the container, and when the stop member is disabled, the cooperative members enable decoupling of the holder assembly from the container. Applicant believes that another reference corresponds to U.S. Pat. No. 6,837,373 B2 issued to Huang on Jan. 4, 2005 for a tool suspension device with a burglarproof feature. However, it differs from the present invention because Huang teaches a tool suspension device for pliers has a suspension board and a bracket. The suspension board has a front, a rear, a clip and a removable locking stub. The clip is mounted on the rear of the suspension board. The removable locking stub is attached to the front of the suspension board. The bracket is mounted on the front of the suspension board and has a U-shaped frame and clamping arms inside the frame. A tool slot is defined vertically through the frame and is adapted to hold a tool that is positioned head down. The removable locking stub prevents upward movement of the tool to prevent the tool from being easily pulled out of the tool slot to steal. The clip is used to hang the tool suspension device on a person's belt. Therefore, the tool suspension device is burglarproof and double-duty.

Applicant believes that another reference corresponds to U.S. Pat. No. 6,076,669 B1 issued to Ling on Jun. 20, 2000 for a tool display rack. However, it differs from the present invention because Ling teaches a tool display rack includes a body with a first engaging member extending from the first end thereof in which a first aperture is defined, a limiting member connected to the body at its first end by a connecting plate and having a recess defined therein, a second engaging member extending from the second end of the limiting member so as to engage with the first aperture, a second aperture defined in the second end of the limiting member so as to receive the first engaging member so that a tool extends through the recess between the body and the limiting member and is limited by the limiting member. The tool can only be taken away from the body by cutting the second engaging member extending through the first aperture in the body.

Applicant believes that another reference corresponds to U.S. Pat. No. 5,996,817 B1 issued to Kao on Dec. 7, 1999 for a tool suspension rack assembly. However, it differs from the present invention because Kao teaches a suspension rack is a rack having a base plate defining at least one hole, at least one suspension plate defining a slot, and at least one fastener member including an abutting plate abutting a first side of the suspension plate. A lug extends from the abutting plate and is received in the slot. A snapping member having a stub extends from the lug and is received in the hole. An enlarged cone-shaped head extends from the stub and abuts a second side of the base plate.

Applicant believes that another reference corresponds to U.S. Pat. No. 5,711,432 B1 issued to Stein, et al. on Jan. 27, 1998 for a pilfer-resistant peg hook assembly. However, it differs from the present invention because Stein, et al. teaches a pilfer-resistant peg hook assembly for supporting a plurality of articles incorporating defined slots and enabling only one article at a time to be removed therefrom is formed of a peg hook and a flipper. The peg hook has a pair of opposed ends and a body connecting the same. One of the hook ends is configured and dimensioned to maintain the hook body in a substantially horizontal first plane when mounted on an appropriate surface, and the other of the hook ends is a free end. The hook body is configured and dimensioned to be received in the slots of the articles and extends only in the first plane. The flipper is pivotably secured adjacent the free end and is movable between an enabling orientation enabling at least partial passage of an article along the hook body and onto the flipper as the article initially moves towards the free end, and a blocking orientation precluding passage of an article onto the flipper as the article moves towards the free end. The flipper is cammed into the blocking orientation as the article continues to pass over the flipper towards the free end.

Applicant believes that another reference corresponds to U.S. Pat. No. 5,624,040 B1 issued to Hono on Apr. 29, 1997 for a theft-preventive display hook system. However, it differs from the present invention because Hono teaches a security system for a display rack is provided in which merchandise in packages is threaded through an opening in the packaging over the free end of a hanger rod for display. The free end of the hanger rod is threaded, and a threaded cap is treated onto the free end of the rod to prevent removal of the package. The cap has a pair of opposed grooves, and a special key 13 is provided to remove the cap.

Applicant believes that another reference corresponds to U.S. Pat. No. 5,275,027 B1 issued to Eklof, et al. on Jan. 4, 1994 for a security device for merchandise display hooks. However, it differs from the present invention because Eklof, et al. teaches a security device is provided for use on pegboard type hooks. The device includes a housing with a lock mechanism, which releasably locks with the tines of a latch to securely grip the rod of the pegboard hook. A simple key-operated camming cylinder is manually operated to release the latch so that merchandise products carried on hook can be removed. The latch can be inserted into the housing and relocked on the hook without using the key.

Other patents describing the closest subject matter provide for a number of more or less complicated features that fail to solve the problem in an efficient and economical way.

None of these patents suggest the novel features of the present invention.

SUMMARY OF THE INVENTION

The instant invention is a lock assembly for retail packaging having contents therein. More specifically, the instant invention is a packaging lock assembly comprising a lock assembly, a key assembly, a hinge assembly, and packaging comprising at least one wall. The lock assembly mounts exteriorly onto the packaging.

The packaging lock assembly may further comprise a rail assembly. The rail assembly is mounted onto a display rack. The rail assembly comprises rail members kept at a spaced apart relationship with respect to each other by a transversal member.

The packaging lock assembly may further comprise a plate assembly comprising a plate and at least one hole. The at least one wall is positioned in between the lock assembly and the plate. The plate assembly mounts interiorly within the packaging.

The lock assembly comprises a locking shaft assembly. The locking shaft assembly comprises a shaft having an end. The lock assembly comprises upper and lower interior walls. The locking shaft assembly extends from the upper interior wall of the lock assembly. The lower interior wall comprises an aperture. The end is biased towards the aperture when the lock assembly is in a locked position.

The instant invention further comprises locking means, whereby the lock assembly suspended from the rail members is placed in the locked position, and the locking shaft assembly is blocked by the transversal member to prevent removal of the packaging from the rail assembly. The lock assembly further comprises a locking assembly and a latch assembly. The latch assembly receives the locking assembly to place the lock assembly in the locked position.

The instant invention further comprises unlocking means, whereby the key assembly is presented into the latch assembly comprising a key hole to cause the locking shaft assembly to shift from the locked position, to an unlocked position, whereby the transversal member does not block the locking shaft assembly to permit removal of the packaging from the rail assembly.

The lock assembly comprises a bottom wall. Protruding from the bottom wall is at least one shaft having a head that snaps though the at least one hole of the plate. The lock assembly further comprises at least one rail channel to receive the rail assembly.

It is therefore one of the main objects of the present invention to provide a lock assembly that is permanently mounted onto a flap or wall section of retail packaging.

It is another object of the present invention to provide a lock assembly that prevents unauthorized individuals from removing retail packaging, with its respective lock assembly, from a rack or display.

It is another object of the present invention to provide a lock assembly that can be readily mounted and unmounted without tools.

It is another object of the present invention to provide a lock assembly that minimizes locking and unlocking time.

It is another object of the present invention to provide a lock assembly that is volumetrically efficient for carrying, transporting, and storage.

It is another object of the present invention to provide a lock assembly that is of a durable and reliable construction.

It is yet another object of the present invention to provide a lock assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
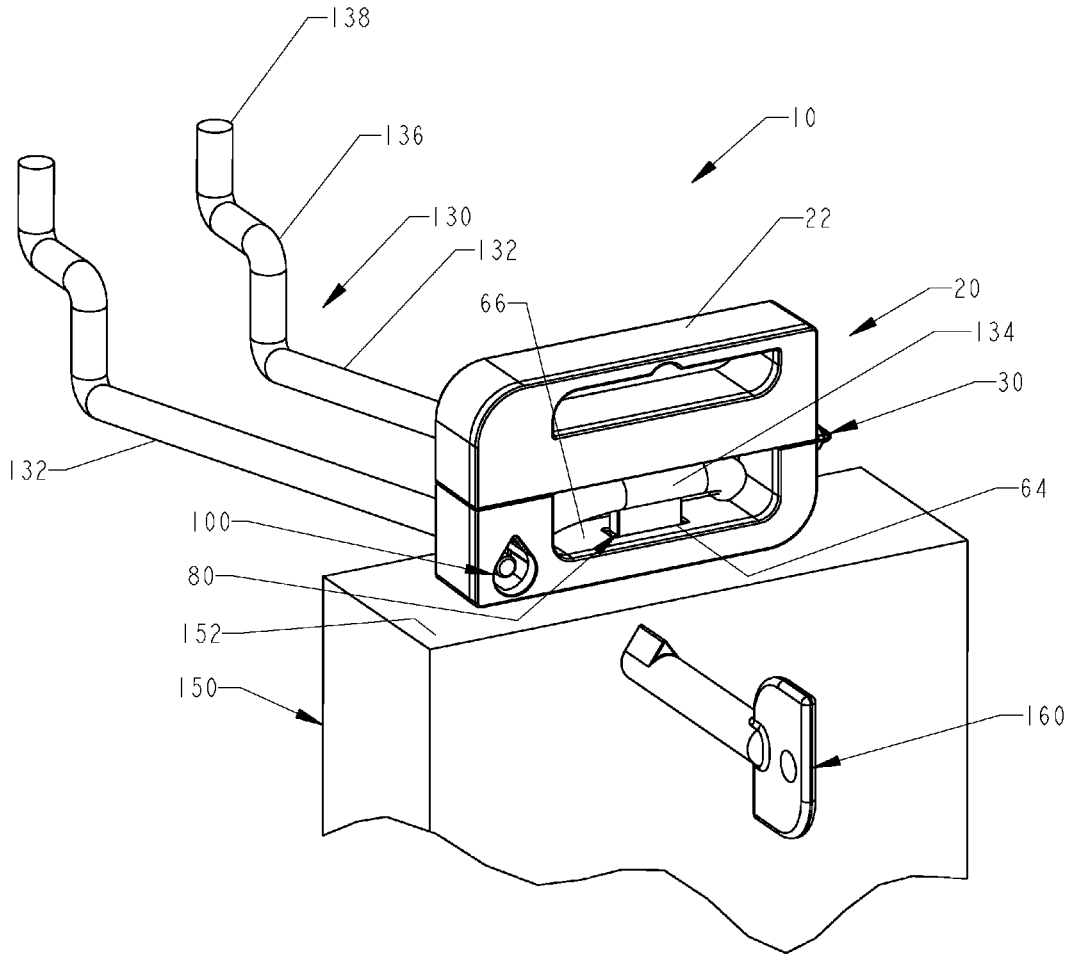
FIG. 1 is an isometric view of a lock assembly of the present invention in a locked position, mounted onto retail packaging while suspended from a rail assembly—duel rail member configuration, and a key assembly.

Referring now to the drawings, the present invention is a lock assembly for retail packaging having contents therein, and is generally referred to with numeral 10.

As seen in FIG. 1, present invention 10 comprises lock assembly 20, hinge assembly 30, rail assembly 130, and key assembly 160. Lock assembly 20 mounts onto rail assembly 130, and key assembly 160 is used to unlock lock assembly 20 from rail assembly 130.

Rail assembly 130, duel rail member configuration, includes rail members 132 kept at a parallel and spaced apart relationship with respect to each other by transversal member 134. Rail members 132 have curvatures 136 next to distal ends 138. A plurality of rail assemblies 130 are usually mounted to display racks in stores, not seen. Packaging 150, comprising products, not seen, typically suspend from rail members 132, and more specifically with instant invention 10, suspend by lock assembly 20 between curvatures 136 and transversal member 134.

As locking means, each lock assembly 20 suspended from rail members 132 is placed in a locked position, whereby locking shaft assembly 80 is blocked by transversal member 134 to prevent removal of packaging 150 therefrom.

Figure 2:
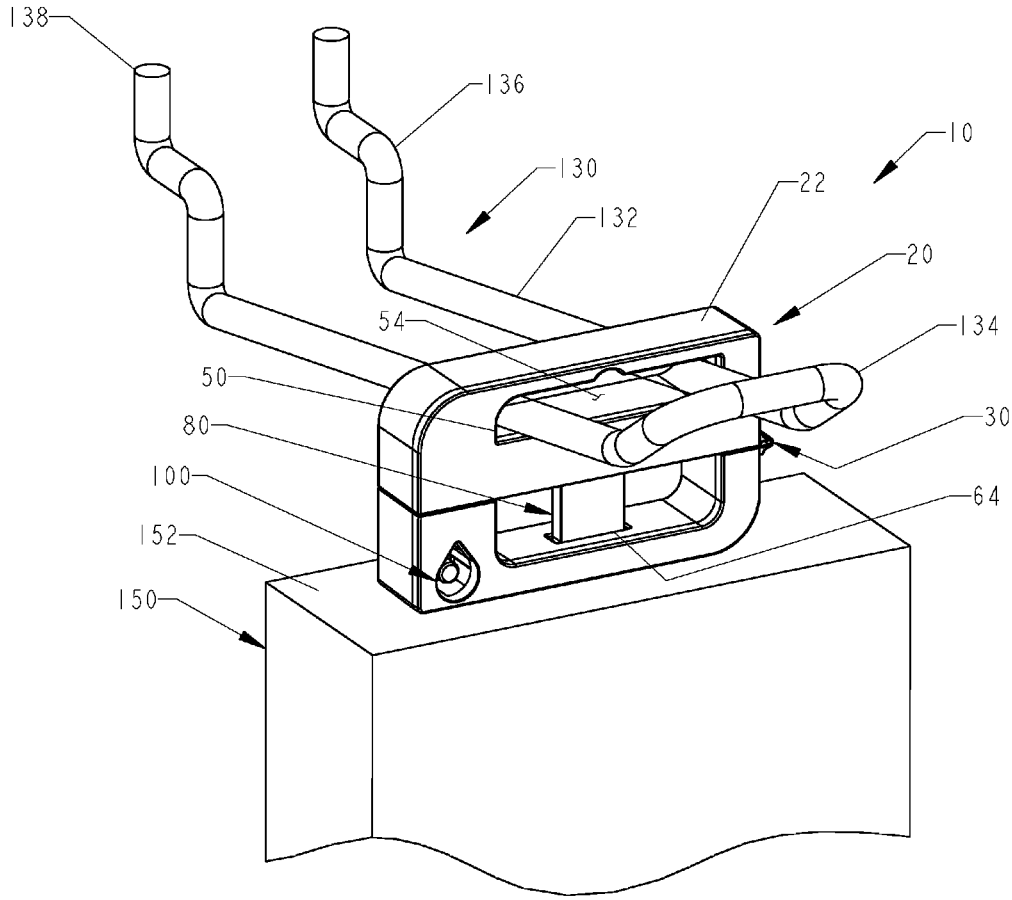
FIG. 2 is an isometric view of the lock assembly of the present invention in the locked position, mounted onto retail packaging while suspended at its rail channel from the rail assembly—duel rail member configuration.

As seen in FIG. 2, lock assembly 20 comprises at least one rail channel 54 to receive rail assembly 130 to permit removal of packaging 150 therefrom without any obstruction, and specifically by locking shaft assembly 80.

Figure 3:
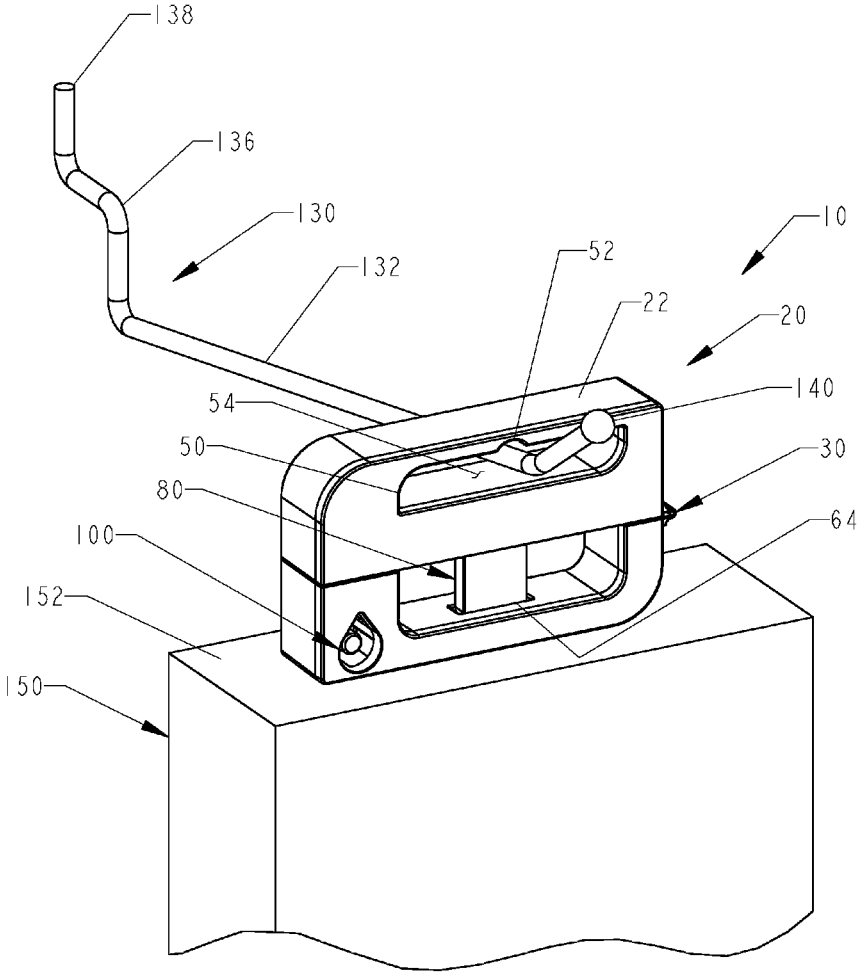
FIG. 3 is an isometric view of the lock assembly of the present invention in the locked position, mounted onto retail packaging while suspended at its rail channel from a rail assembly—single rail member configuration.

As seen in FIG. 3, at least one rail channel 54 comprises groove 52 to receive rail assembly 130, single rail member configuration having end 140, to permit removal of packaging 150 therefrom without any obstruction, and specifically by locking shaft assembly 80.

In operation, distal ends 138 are inserted through holes of a look hoop system, not seen, and curvatures 136 hold them in place. Packaging 150, comprising products, not seen, typically suspend from rail members 132, and more specifically suspend between curvatures 136 and transversal member 134. In an alternate embodiment, rail assembly 130 may extend from a freestanding display rack, or other display assembly having an elongated rail assembly member from which packaging 150 may hang therefrom.

Figure 4:
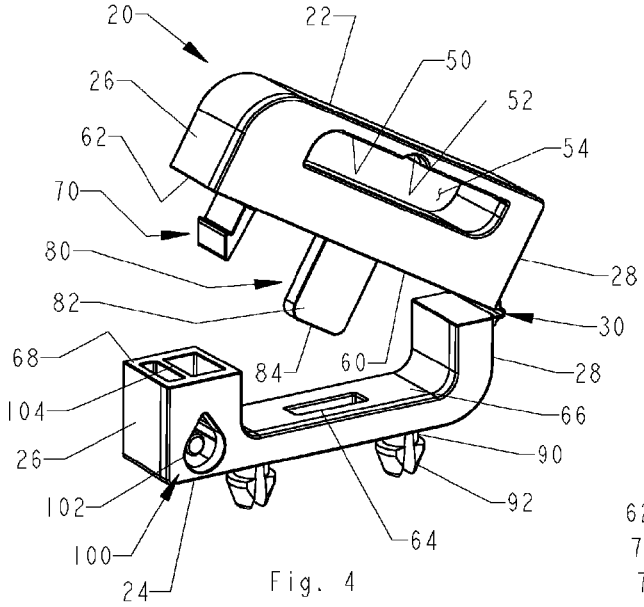
FIG. 4 is an isometric view of the lock assembly of the present invention in an unlocked position.
Figure 5:
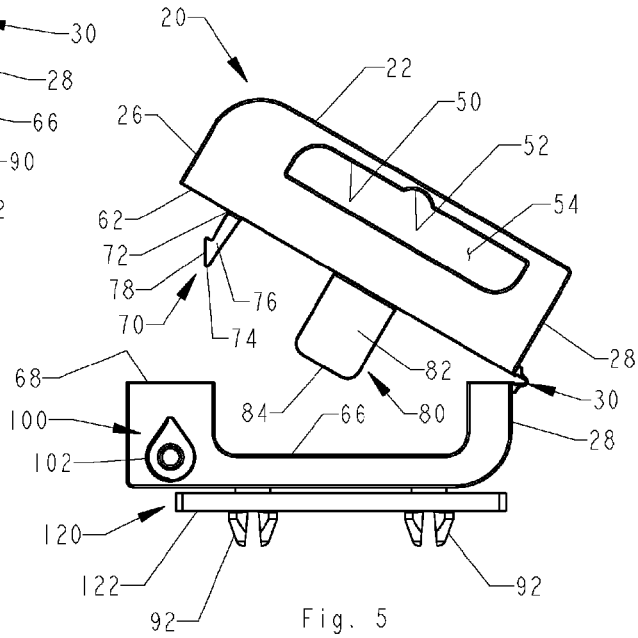
FIG. 5 is a front elevation view of the lock assembly of the present invention in the unlocked position and the plate assembly.
Figure 6:
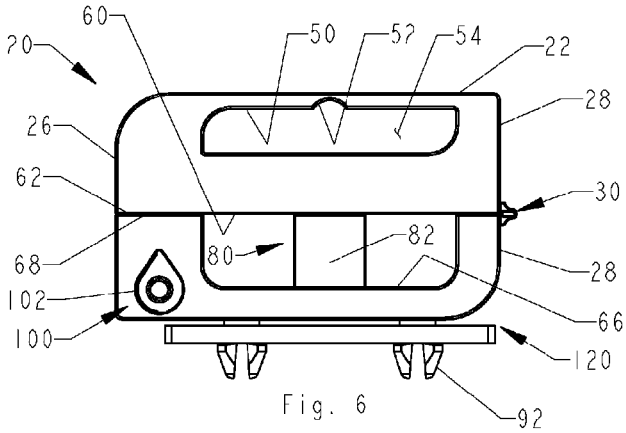
FIG. 6 is a front elevation view of the lock assembly of the present invention in the locked position and the plate assembly.

As seen in FIGS. 4, 5, and 6, lock assembly 20 comprises top wall 22, bottom wall 24, and sidewalls 26 and 28. Lock assembly 20 further comprises upper and lower interior walls 60 and 66. Extending from upper interior wall 60 towards aperture 64 is locking shaft assembly 80. Locking shaft assembly 80 comprises shaft 82 having end 84. Defined at lower interior wall 66 is aperture 64. Protruding from bottom wall 24 is at least one shaft 90 having head 92. Lock assembly 20 mounts exteriorly onto packaging 150. At least one rail channel 54 is defined by rail channel interior wall 50 having groove 52.

As seen in FIG. 5, lock assembly 20 further comprises locking assembly 70. Locking assembly 70 comprises shaft 76 extending from base 72 at upper joint wall 62, to end 74. Extending from end 74 is angled edge 78. It is noted that angled edge 78 is wider than shaft 76 to define a catch.

Figure 7:
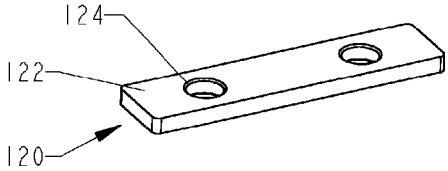
FIG. 7 is an isometric view of a plate assembly.

As seen in FIG. 7, plate assembly 120 comprises plate 122 and at least one hole 124. In a preferred embodiment for stability and/or reinforcement, wall 152 of packaging 150, as seen in FIGS. 1, 2, and 3, is positioned in between lock assembly 20 and plate 122, whereby at least one hole 124 receives head 92 therethrough to snap into place. Therefore, plate assembly 120 mounts interiorly within packaging 150 if necessary for stability and/or reinforcement. It is noted that plate assembly 120 is not required if wall 152 of packaging 150 is sufficiently strong. Although not illustrated, it is understood that wall 152 comprises a hole to accommodate head 92 and shaft 90 therethrough.

Figure 8:
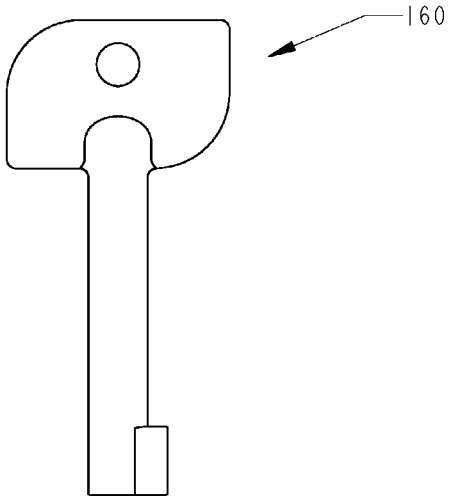
FIG. 8 is a front elevation view of the key assembly.
Figure 9:
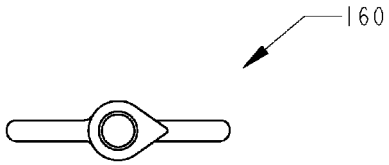
FIG. 9 is a bottom view of the key assembly.

Seen in FIGS. 8 and 9 is key assembly 160. Key assembly 160 can be any key cooperatively shaped to fit within key hole 102 to actuate to cause locking assembly 70 to shift from the locked position seen in FIG. 6, to the unlocked position seen in FIGS. 4 and 5.

Figure 10:
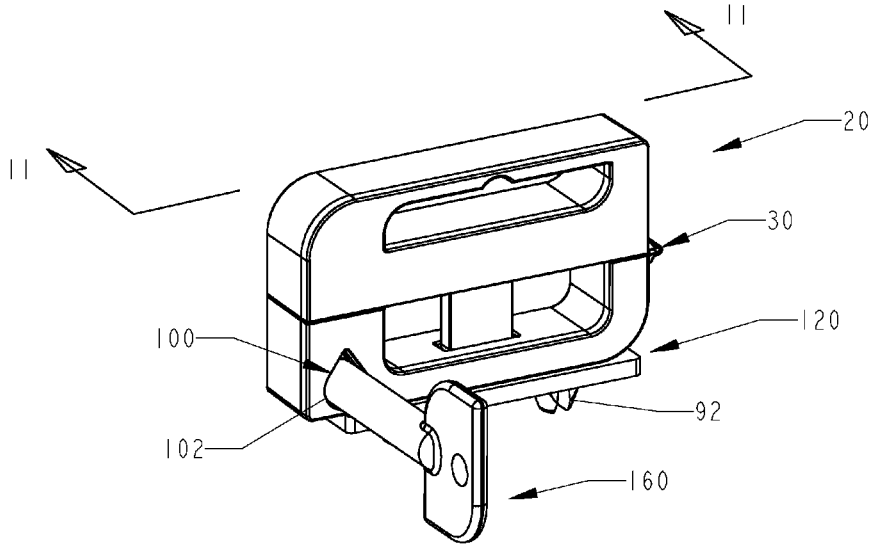
FIG. 10 is an isometric view of the lock assembly of the present invention in the locked position with the key assembly inserted therein, and with the plate assembly.
Figure 11:
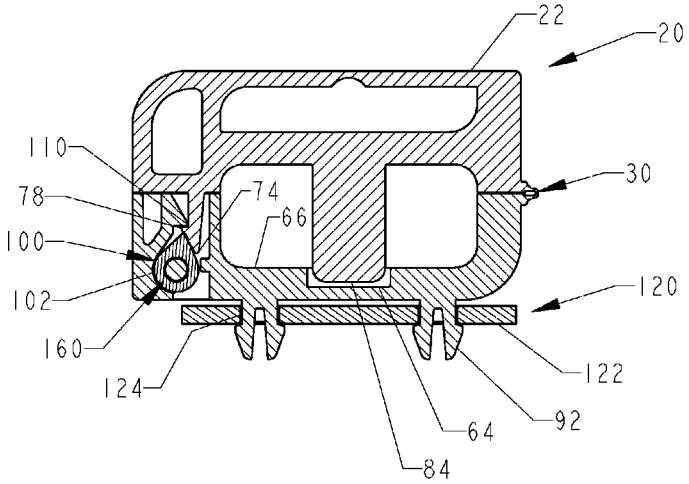
FIG. 11 is a cross section view taken along lines 11-11 from FIG. 10.

As seen in FIGS. 10 and 11, lock assembly 20 is in the locked position, whereby end 84 is biased towards aperture 64. For illustrative purposes, at least one hole 124 of plate 122 receives head 92 therethrough to snap into place. Plate assembly 120 provides stability and/or reinforcement when lock assembly 20 is mounted onto wall 152 of packaging 150, seen in FIGS. 1, 2, and 3. Key assembly 160 is aligned and presented into key hole 102 of latch assembly 100. Key assembly 160 is utilized to place lock assembly 20 to the unlocked position seen in FIGS. 12 and 13, whereby key hole 102 is shaped to cooperatively receive a distal end of key assembly 160 when presented therein.

Figure 12:
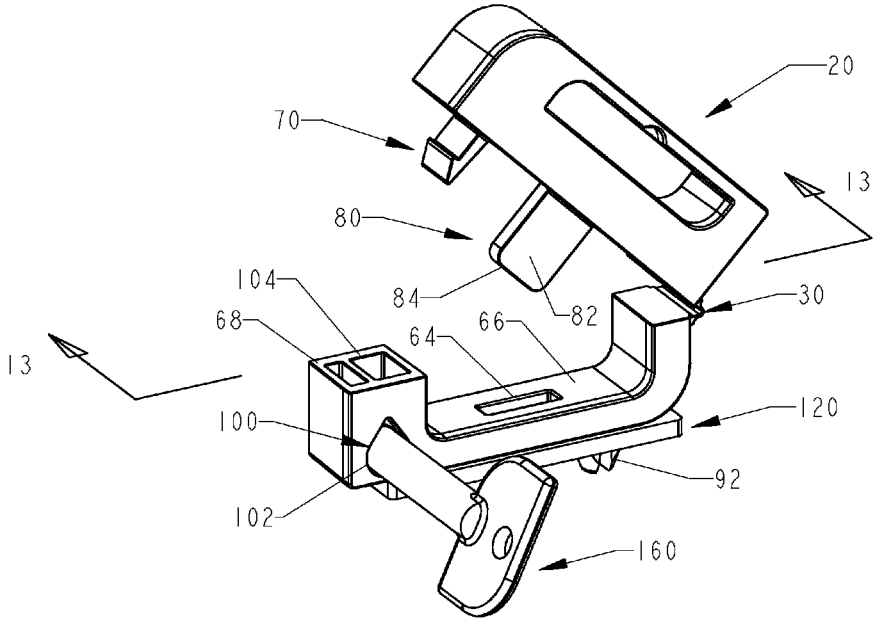
FIG. 12 is an isometric view of the lock assembly of the present invention in the unlocked position with the key assembly inserted therein and rotated a predetermined distance, and with the plate assembly.
Figure 13:
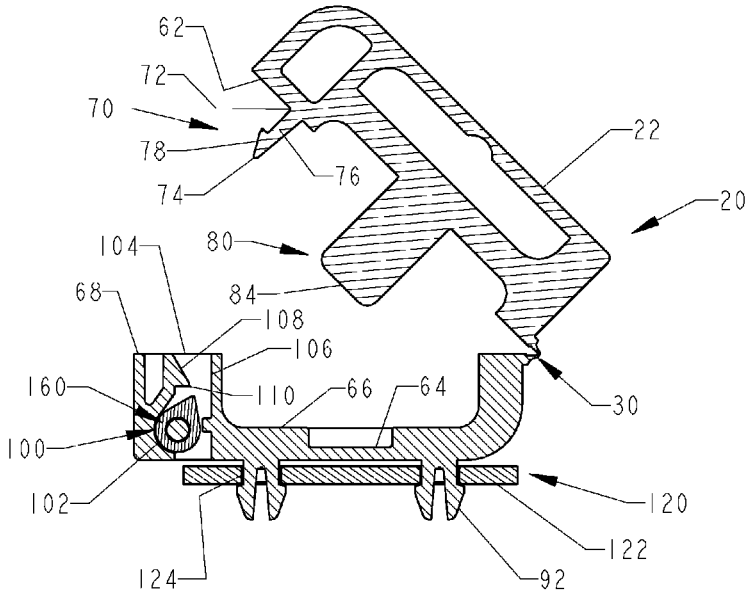
FIG. 13 is a cross section view taken along lines 13-13 from FIG. 12.

As seen in FIGS. 12 and 13, lock assembly 20 further comprises latch assembly 100. Latch assembly 100 receives locking assembly 70 to place lock assembly 20 in the locked position. Latch assembly 100 comprises key hole 102, and aperture 104 at lower joint wall 68. Extending from aperture 104 are interior sidewall 106, and interior angled sidewall 108 that terminates at locking latch 110.

As unlocking means, key assembly 160 is presented into latch assembly 100 comprising key hole 102 to cause locking shaft assembly 80 to shift from the locked position, to an unlocked position, whereby transversal member 134 does not block locking shaft assembly 80 to permit removal of packaging 150 from rail assembly 130. More specifically, key assembly 160 is presented into key hole 102. Key assembly 160 is rotated by placing a predetermined force for a predetermined distance against angled edge 78 until no longer obstructed by locking latch 110 to enable locking shaft assembly 80 to shift from the locked position, to an unlocked position.

Figure 14:
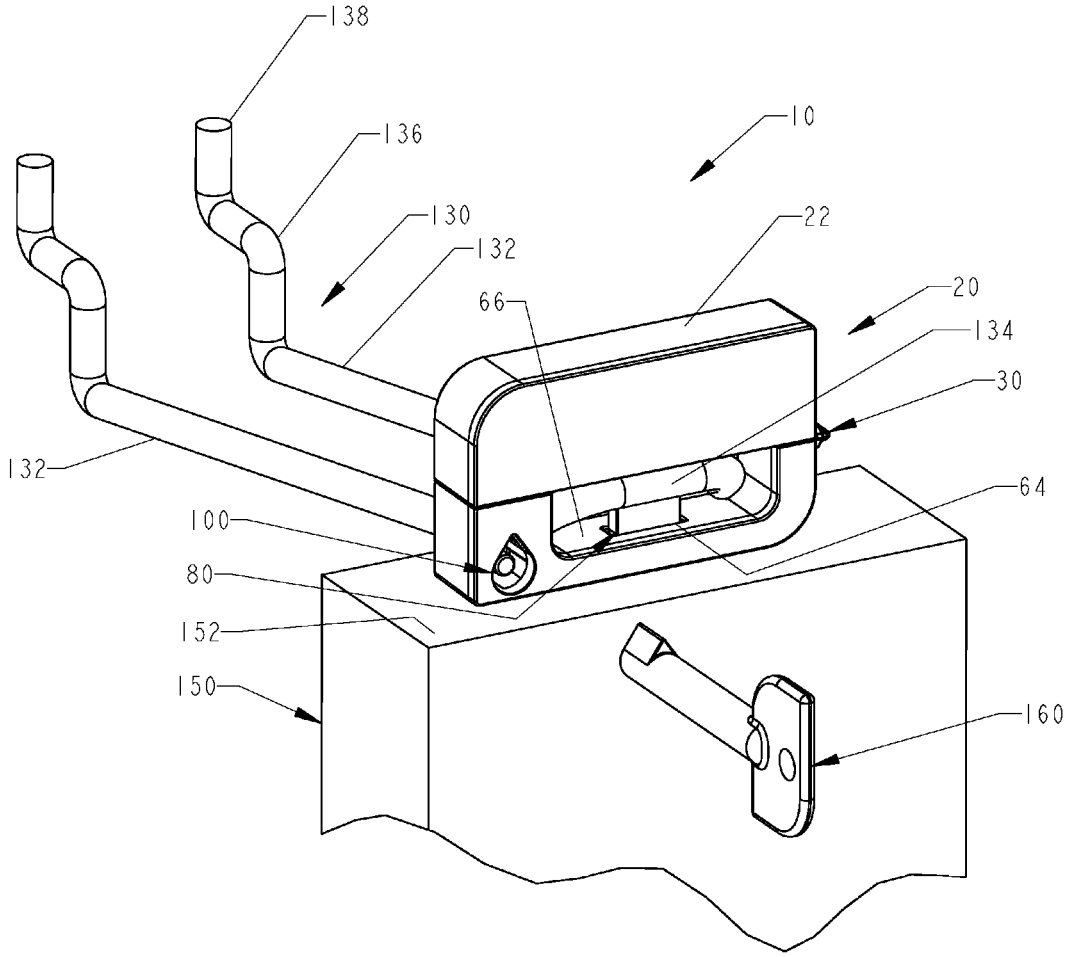
FIG. 14 is an isometric view of an alternate embodiment of the lock assembly of the present invention in a locked position, mounted onto retail packaging while suspended from a rail assembly—duel rail member configuration, and a key assembly.

Seen in FIG. 14 is an alternate embodiment of lock assembly 20 in the locked position, mounted onto packaging 150 while suspended from rail assembly 130, duel rail member configuration. It is noted that the illustrated alternate embodiment does not comprise an at least one rail channel 54 to receive rail assembly 130.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A packaging lock assembly, comprising:

A) a lock assembly comprising a locking shaft assembly having a shaft with an end, said lock assembly further comprises upper and lower interior walls, said locking shaft assembly extends from said upper interior wall, said lower interior wall comprises an aperture, and further comprising locking means, whereby said locking shaft assembly is blocked by a transversal member and said end is biased towards said aperture when said lock assembly is in a locked position;

B) a key assembly;

C) a hinge assembly; and

D) packaging comprising at least one wall, said lock assembly mounts exteriorly onto said packaging E) a rail assembly.

2. The packaging lock assembly set forth in claim 1, further characterized in that said rail assembly is mounted onto a display rack.

3. The packaging lock assembly set forth in claim 1, further characterized in that said rail assembly comprises rail members kept at a spaced apart relationship with respect to each other by said transversal member.

4. The packaging lock assembly set forth in claim 1, further comprising:

E) a plate assembly comprising a plate and at least one hole.

5. The packaging lock assembly set forth in claim 4, further characterized in that said at least one wall is positioned in between said lock assembly and said plate.

6. The packaging lock assembly set forth in claim 4, further characterized in that said plate assembly mounts interiorly within said packaging.

7. The packaging lock assembly set forth in claim 3, further characterized in that with said locking means, said lock assembly is suspended from said rail members when placed in said locked position, and said locking shaft assembly is blocked by said transversal member to prevent removal of said packaging from said rail assembly.

8. The packaging lock assembly set forth in claim 7, further characterized in that said lock assembly further comprises a locking assembly.

9. The packaging lock assembly set forth in claim 8, further characterized in that said lock assembly further comprises a latch assembly.

10. The packaging lock assembly set forth in claim 9, further characterized in that said latch assembly receives said locking assembly to place said lock assembly in said locked position.

11. The packaging lock assembly set forth in claim 10, further comprising unlocking means, whereby said key assembly is presented into said latch assembly comprising a key hole to cause said locking shaft assembly to shift from said locked position, to an unlocked position, whereby said transversal member does not block said locking shaft assembly to permit removal of said packaging from said rail assembly.

12. The packaging lock assembly set forth in claim 4, further characterized in that said lock assembly comprises a bottom wall, protruding from said bottom wall is at least one shaft having a head that snaps though said at least one hole of said plate.

13. The packaging lock assembly set forth in claim 1, further characterized in that said lock assembly comprises at least one rail channel to receive said rail assembly.

* * * * *